US011309147B2

(12) United States Patent
Shan et al.

(10) Patent No.: US 11,309,147 B2
(45) Date of Patent: Apr. 19, 2022

(54) LINEAR SLIDE SWITCH USED FOR SPEED-CONTROL

(71) Applicant: SCHNEIDER ELECTRIC (AUSTRALIA) PTY LTD, Macquarie Park (AU)

(72) Inventors: Fuhua Shan, Shenzhen (CN); Zhen Ma, Shenzhen (CN); Dahai Zhang, Shenzhen (CN)

(73) Assignee: SCHNEIDER ELECTRIC (AUSTRALIA) PTY LTD, Macquarie Park (AU)

( * ) Notice: Subject to any disclaimer, the term of this patent is extended or adjusted under 35 U.S.C. 154(b) by 0 days.

(21) Appl. No.: 17/095,643

(22) Filed: Nov. 11, 2020

(65) Prior Publication Data

US 2022/0093352 A1 Mar. 24, 2022

(30) Foreign Application Priority Data

Sep. 23, 2020 (CN) ..... 202022112415.1

(51) Int. Cl.
*H01H 15/24* (2006.01)
*H01H 15/10* (2006.01)

(52) U.S. Cl.
CPC ..... *H01H 15/10* (2013.01); *H01H 15/24* (2013.01); *H01H 2205/016* (2013.01); *H01H 2227/032* (2013.01); *H01H 2231/052* (2013.01)

(58) Field of Classification Search
CPC ..... H01H 1/365; H01H 15/24; H01H 23/164; H01H 15/10; H01H 2205/016; H01H 227/032; H01H 2231/052
See application file for complete search history.

(56) References Cited

U.S. PATENT DOCUMENTS 3,888,807 A * 6/1975 Lockard ..... H01H 3/20 200/16 R
4,152,565 A * 5/1979 Rose ..... H01H 15/005 200/16 A
5,293,103 A * 3/1994 Hanna ..... H02P 7/18 318/268

* cited by examiner

*Primary Examiner* — Vanessa Girardi
(74) *Attorney, Agent, or Firm* — Locke Lord LLP

(57) ABSTRACT

Disclosed embodiments relate to a socket. A speed-control switch, including: a housing including a top plate provided with a central opening extending in a length direction; a push rod at least partially contained in the housing, and a first end of the push rod protruding out of the housing from the central opening and capable of sliding in the central opening; a plurality of connection terminals provided in pairs in the housing and configured to: selectively engage with a second end of the push rod opposite to the first end to limit a plurality of speed indications of the speed-control switch; and a speed selection assembly with a part thereof set on the top plate and configured to allow a selection for a plurality of speed indications of the speed-control switch as the push rod slides in the central opening. The speed-control switch achieve speed switching with a small force. The speed-control switch is suitable for high-power electrical appliances, requires a small number of components, reducing manufacturing costs and assembly time and assembly difficulty.

18 Claims, 10 Drawing Sheets

LINEAR SLIDE SWITCH USED FOR SPEED-CONTROL

FIELD

Embodiments of the present disclosure generally relate to a speed-control switch, and more particularly to a straight push speed-control switch such as for fans.

BACKGROUND

Switches used for electrical appliances such as fans are usually provided with a plurality of selectable speeds. These speeds can be selected through a speed-control switch so that electrical appliances such as fans can be driven by different powers. For this kind of speed-control switch, a push button is usually installed on a push button panel, and a user selects a desired speed by pushing the button.

However, in some conventional designs, a relatively large force is usually required in order to push the push button of such a push button switch, that is to say, the relatively large resistance provided by the internal structure of the switch is required to be overcome so as to switch from one speed to another. In addition, unstable contact often occurs between an internal conductive rod and a connection terminal due to long time use of such kind of push button switch. As a result of this kind of unstable contact, the contact resistance could increase, and more heat and arc could be generated when switching the speed, making such a switch unsuitable for high-power electrical appliances.

SUMMARY

The present disclosure provides a speed-control switch to solve the above-mentioned and other potential problems in the prior art.

According to an aspect of the present disclosure, a speed-control switch is provided. The speed-control switch comprises: a housing comprising a top plate provided with a central opening extending in a length direction; a push rod at least partially received in the housing, and a first end of the push rod protruding out of the housing from the central opening and capable of sliding in the central opening; a plurality of connection terminals provided in pairs in the housing and configured to selectively engage with a second end of the push rod opposite to the first end to define a plurality of speed indications of the speed-control switch; and a speed selection assembly, a part of the speed selection being provided on the top plate and, the speed selection assembly being configured to allow a selection for a plurality of speed indications of the speed-control switch, as the push rod slides in the central opening.

According to an embodiment of the present disclosure, the speed-control switch further comprises a push button panel provided on a first surface of the top plate and capable of translating relative to the top plate, and the push button panel is configured to be engaged with the first end of the push rod protruding from the central opening, so that the push rod can slide in the central opening with the translating of the push button panel relative to the top plate According to an embodiment of the present disclosure, the speed selection assembly comprises: one or more protrusions provided on one of the top plate and the push button panel; and one or more grooves provided on the other of the top plate and the push button panel, wherein the one or more protrusions can be engaged with the one or more grooves for a certain number of times corresponding to a number of the plurality of speed indications.

According to an embodiment of the present disclosure, the one or more grooves are formed in the form of troughs of a wavy surface, and the one or more protrusions are formed in the form of crests of the wavy surface.

According to an embodiment of the present disclosure, each of the one or more grooves can be engaged with a certain number of the protrusions corresponding to the number of the plurality of speed indications.

According to an embodiment of the present disclosure, each of the one or more protrusions can be engaged with a certain number of the grooves corresponding to the number of the plurality of speed indications.

According to an embodiment of the present disclosure, the one or more grooves are provided on a cantilever extending from the top plate.

According to an embodiment of the present disclosure, the top plate is provided with a first opening and a second opening located on both sides of the central opening, respectively, the cantilever is provided in at least one of the first opening and the second opening, and the cantilever is spaced apart from the first opening and the second opening in the length direction.

According to an embodiment of the present disclosure, the cantilever comprises: a first arm plate extending perpendicularly to the top plate from a second surface of the top plate opposite to the first surface; and a second arm plate extending towards the central opening from an end of the first arm plate away from the top plate, wherein the one or more grooves are provided on a surface of the second arm plate facing the central opening, and wherein the one or more protrusions are provided on an outward-facing side surface of a support arm, the support arm extending from a second surface of the push button panel facing the top plate in an assembled state.

According to an embodiment of the present disclosure, the cantilever comprises a first arm plate extending perpendicularly to the top plate from the first surface of the top plat; a second arm plate extending towards the central opening from an end of the first arm plate away from the top plate, a third arm plate extending perpendicularly to the second arm plate from an end of the second arm plate away from the first arm plate, wherein the one or more grooves are provided on a surface of the third arm plate facing the central opening, and wherein the one or more protrusions are provided on an outward-facing side surface of a support arm, the support arm extending from a second surface of the push button panel facing the top plate in an assembled state.

According to an embodiment of the present disclosure, the cantilever extends parallel to the top plate from a side wall of the central opening of the top plate; the one or more grooves are provided on a surface of the cantilever facing a second surface of the push button panel, the second surface facing the top plate in an assembled state of the push button panel; and the one or more protrusions extend from the push button panel toward the top plate.

According to an embodiment of the present disclosure, the cantilever is spaced apart from the central opening in the length direction, and the push rod slides in a gap between opposite cantilevers extending from opposite side walls of the central opening.

According to an embodiment of the present disclosure, the one or more grooves are provided on a side wall of the central opening of the top plate; and the one or more protrusions are provided on an outward-facing side surface of a support arm, the support arm extending from the push button panel in a direction perpendicular to the push button panel.

According to an embodiment of the present disclosure, the housing further comprises a lower housing to which the top plate is attached.

According to an embodiment of the present disclosure, the second end of the push rod is provided with a conductor rod fixedly attached to the second end of the push rod and extending in a width direction, and at one of the plurality of speed indications, the conductor rod causes a pair of connection terminals of the plurality of connection terminals to be electrically conducted.

According to an embodiment of the present disclosure, the plurality of connection terminals comprise two rows of connection terminals spaced apart from each other in the width direction, and the second end of the push rod moves between the two rows of connection terminals; and each pair of connection terminals is symmetrically arranged with respect to the second end of the push rod.

According to an embodiment of the present disclosure, the speed-control switch further comprises an elastic piece attached to the push rod and in contact with the conductor rods to bias the conductor rods toward the plurality of connection terminals.

According to an embodiment of the present disclosure, the push button panel comprises a recess recessed from a second surface of the push button panel facing the top plate in an assembled state and protruding beyond a plane where the push button panel is located, and the first end of the push rod is held within the recess.

According to an embodiment of the present disclosure, the housing is provided with a guide groove, and the push rod is provided with a guided portion at a middle position of the push rod, wherein the guided portion (23) slides in the guide groove.

In the speed-control switch according to the embodiment of the present disclosure, the speed-control switch can use a small force to switch the speed, and it is suitable for high-power electrical appliances. The speed-control switch requires a small number of components, which can reduce manufacturing costs and reduce assembly time and assembly difficulty.

The Summary is provided to introduce a selection of concepts in a simplified form, which will be further described in the following specific embodiments. The Summary is not intended to identify the key features or main features of the present disclosure, nor is it intended to limit the scope of the present disclosure.

DETAILED DESCRIPTION OF EMBODIMENTS

Preferred embodiments of the present disclosure will be described in more detail below with reference to the drawings. Although the drawings illustrate preferred embodiments of the present disclosure, it should be appreciated that the present disclosure can be implemented in various manners and should not be limited to the embodiments explained herein. On the contrary, the embodiments are provided to make the present disclosure more thorough and complete and to fully convey the scope of the present disclosure to those skilled in the art.

As used herein, the term "include" and its variants are to be read as open-ended terms that mean "include, but is not limited to." The term "or" is to be read as "and/or" unless the context clearly indicates otherwise. The term "based on" is to be read as "based at least partially on." The terms "one example embodiment" and "one embodiment" are to be read as "at least one example embodiment." The term "a further embodiment" is to be read as "at least a further embodiment." The terms "first", "second" and so on can refer to same or different objects. The following text also can include other explicit and implicit definitions.

Figure 1A:
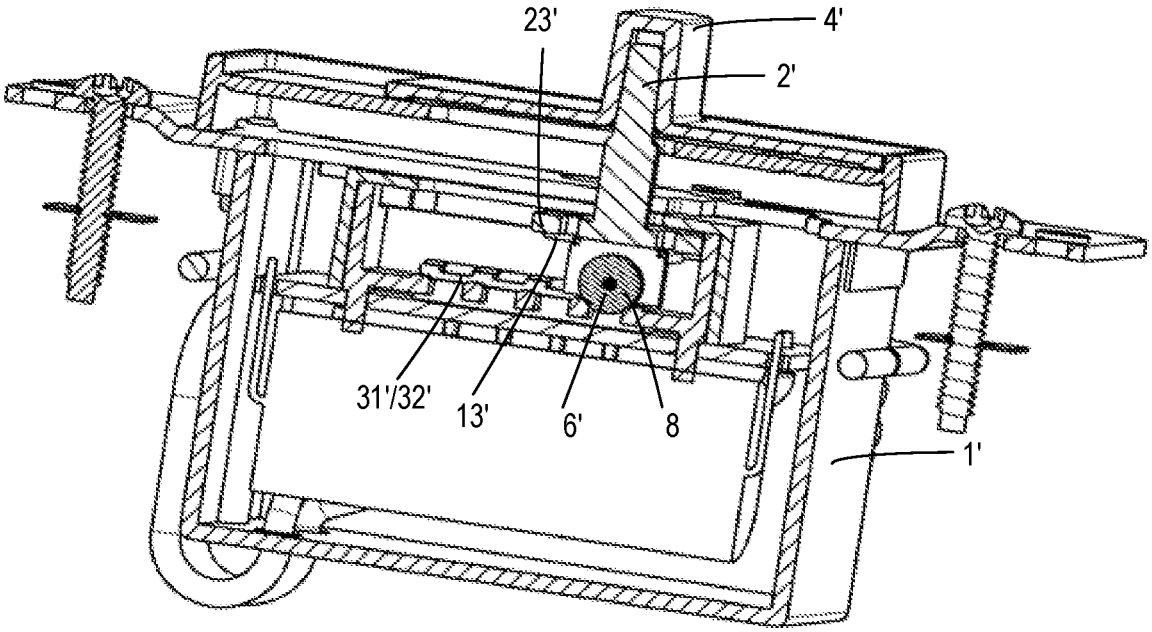
FIG. 1A is a perspective sectional view illustrating a speed-control switch according to a conventional design.
Figure 1B:
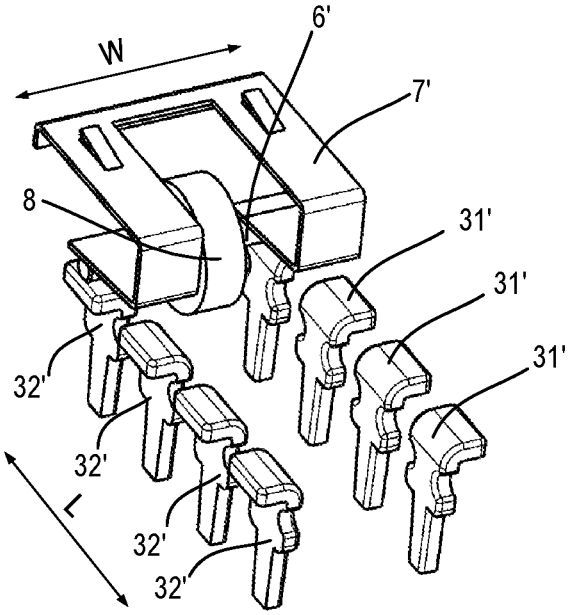
FIG. 1B is a perspective view illustrating a connection terminal, an elastic piece, a conductor rod and a rubber wheel in an assembled state inside the speed-control switch according to the conventional design.

The speed-control switch in the conventional design will now be analyzed with reference to FIGS. 1A, 1B, 2A and 2B in order to explain the shortcomings of the conventional speed-control switch. As shown in FIGS. 1A and 1B, the conventional speed-control switch includes a housing 1', a push rod 2', a connection terminal 3' and a push button panel 4'. An upper end of the push rod 2' protrudes out of the housing 1' to engage with the push button panel 4', and the lower end of the push rod 2' is provided with a conductive rod 6' and a rubber wheel 8, and the conductive rod 6' passes through a center of the circle of the rubber wheel 8. In order to make sure that the end of the conductor rod 6' stably contacts with the connection terminal 3', the speed-control switch further includes an elastic piece 7' (as shown in FIG. 1B). The elastic piece 7' is fixedly mounted to the push rod 2', so that the elastic piece 7', the push rod 2' and the conductor rod 6' move together, and the elastic piece 7' presses the conductor rod 6' towards the connection terminals 31' and 32' (as shown in FIG. 1). The housing 1 is also provided with a guide groove 13', and the push rod 2 is correspondingly provided with a guided portion 23' sliding in the guide groove 13'.

Figure 2A:
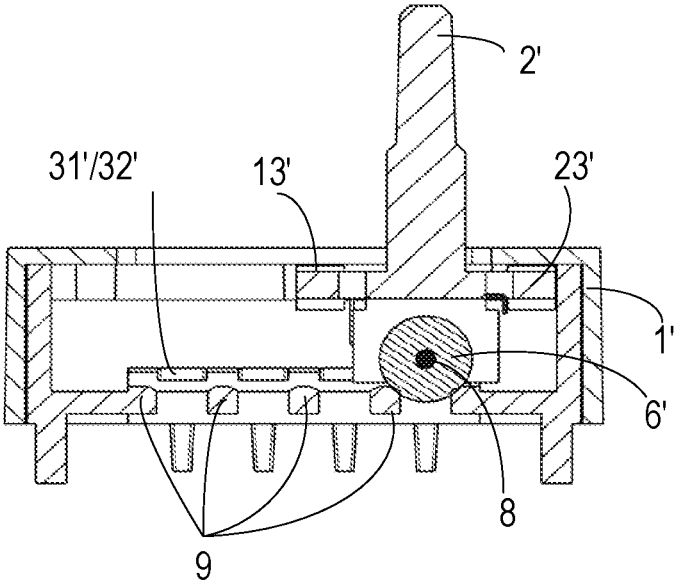
FIG. 2A is a cross-sectional view illustrating a part of the speed-control switch shown in FIG. 1A.

As shown in FIG. 2A, a spacer 9 is provided between adjacent connection terminals 31' or 32'. At one speed, the rubber wheel 8 is held by two adjacent spacers 9. In a process of switching from one speed to another, the rubber wheel 8 needs to roll over one spacer 9 to be held by the next pair of spacers 9 to complete speed switching. During the switching process, especially when passing over the spacer 9, the rubber wheel 8 will have to overcome a relatively large resistance.

Figure 2B:
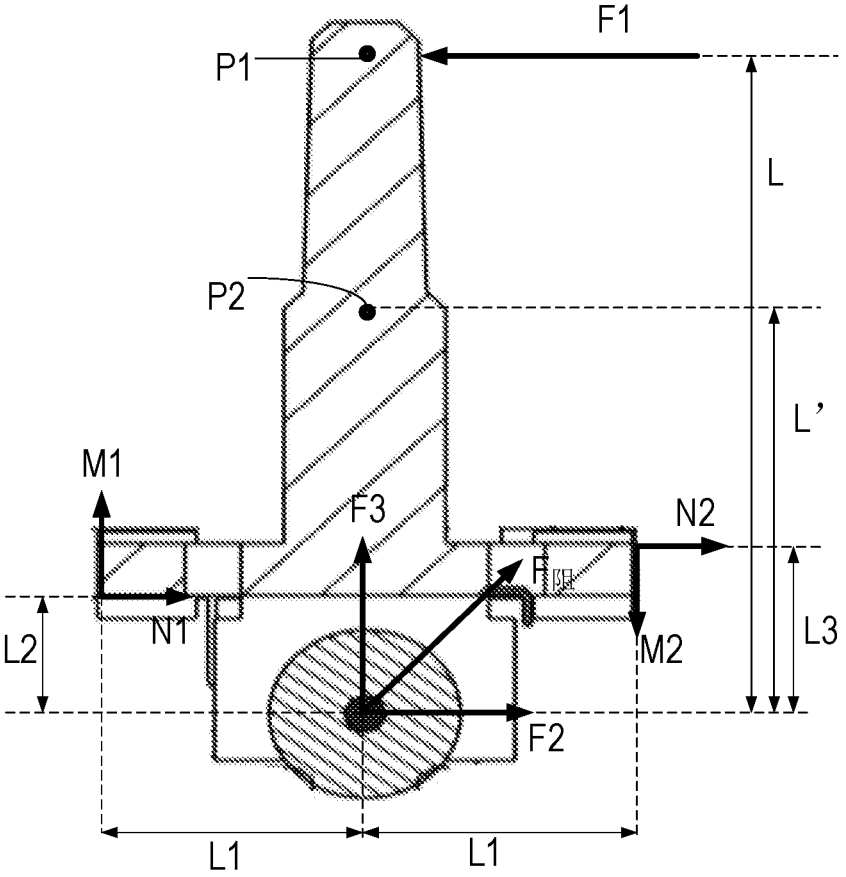
FIG. 2B is a view illustrating the forces applied on the speed-control switch shown in FIG. 1A.

Force balance and torque balance of the conventional speed-control switch will be analyzed with reference to FIG. 2B as follows. As shown in FIG. 2B, supposing that a user applies a force F1 to the push rod 2' at a position P1 (for example, the push rod 2' is pushed to the left), and in a process of pushing the push rod 2' to drive the rubber wheel 8 to move, resistance $F_{resistance}$ applied to the rubber wheel 8 by an internal structure (that is, the resistance applied to the push rod 2' through the rubber wheel 8) can be decomposed into F2 and F3, where F2 goes to the right in the horizontal direction and F3 goes in the vertical direction. In addition, in the process of the guided portion 23' sliding in the guide groove 13', the guide groove 13' exerts a force to the guided portion 23'. The force applied to the guided portion 23' on the left side thereof can be decomposed into an upward force M1 and a rightward force N1, and the force applied to the guided portion 23' on the right side thereof can be decomposed into a downward force M2 and a rightward force N2.

Then, the force balance on push rod 2' can be expressed as:

$$N1+N2+F2=F1 \qquad \text{Equation(1).}$$

The torque balance on the push rod 2' can be expressed as:

$$(M1+M2)*L1+N1*L2+N2*L3=F1*L \qquad \text{Equation(2).}$$

For equation (1), assuming that N1 and N2 remain unchanged, since greater resistance will be generated during speed shifting, that is, a greater F2 will be generated during speed shifting, a greater F1 is required so as to push the rubber wheel 8.

In addition, in the conventionally designed speed-control switch, the conductive rod 6' is held by the rubber wheel 8, and is biased toward the connection terminal 31' or 32' by the elastic piece 7'. The rubber wheel 8 also exerts a force on the conductor rod 6', but the force is unstable due to the assembly accuracy, the material and size of the rubber wheel 8, and thus the electrical contact between the conductor rod 6' and the connection terminal 31' or 32' is unstable. In the case of unstable electrical contact, the contact resistance increases due to the presence of insulating air. When switching the speed, a lot of heat and even an arc will be generated. Therefore, this conventionally designed speed-control switch is not suitable for high-power electrical appliances using high-current.

The structure of the speed-control switch 100 according to an exemplary embodiment of the present disclosure will be described in detail below in conjunction with FIGS. 3 to 17.

Figure 3:
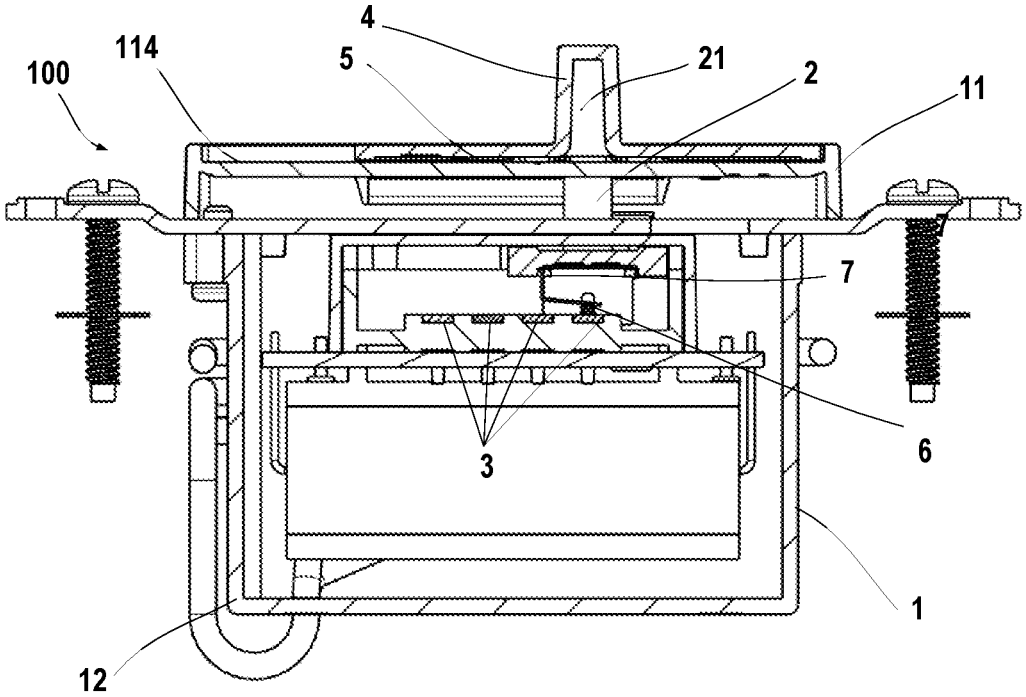
FIG. 3 is a perspective cross-sectional view illustrating the speed-control switch according to an embodiment of the present disclosure.
Figure 4:
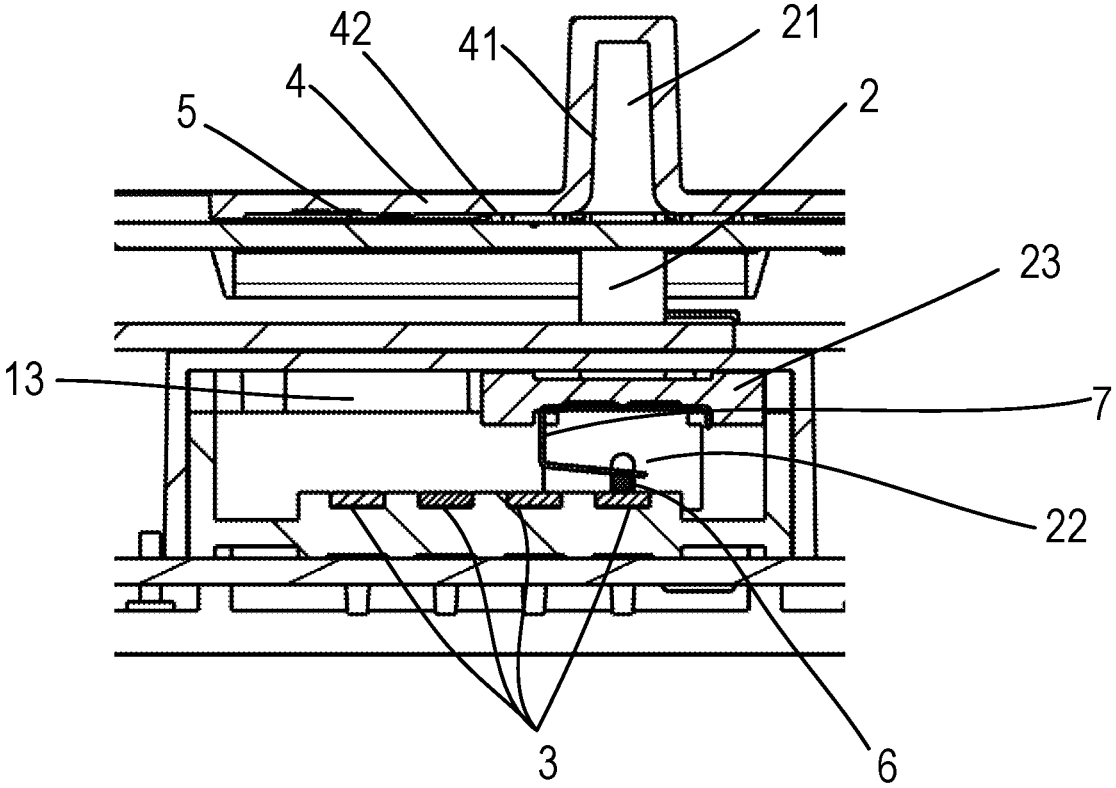
FIG. 4 is an enlarged cross-sectional view illustrating a part of the speed-control switch shown in FIG. 3.

As shown in FIGS. 3 and 4, in general, the speed-control switch 100 includes: a housing 1, a push rod 2, a push button panel 4, a plurality of connection terminals 3, and a speed selection assembly 5.

The housing 1 includes a top plate 11 provided with a central opening 111 extending in the length direction L, as shown more clearly in FIGS. 6-7, 9-11, 13-14 and 16. The housing 1 is further provided with a guide groove 13 at a position close to the middle of the push rod 2. Correspondingly, as shown in FIG. 4, the push rod 2 is also provided with a guided portion 23 sliding in the guide groove 13. The guide groove 13 also plays a role in positioning, so that the push rod 2 is stationary in a direction from a first end 21 thereof to a second end 22 thereof, and can only slide in the central opening 111 in a direction perpendicular to the direction from the first end 21 thereof to the second end 22 thereof. More details will be explained below. The housing 1 also includes a lower housing 12 attached to the top plate 11, and thereby the top plate 11 and the lower housing 12 are separately arranged and can be made of different materials as required.

Figure 5:
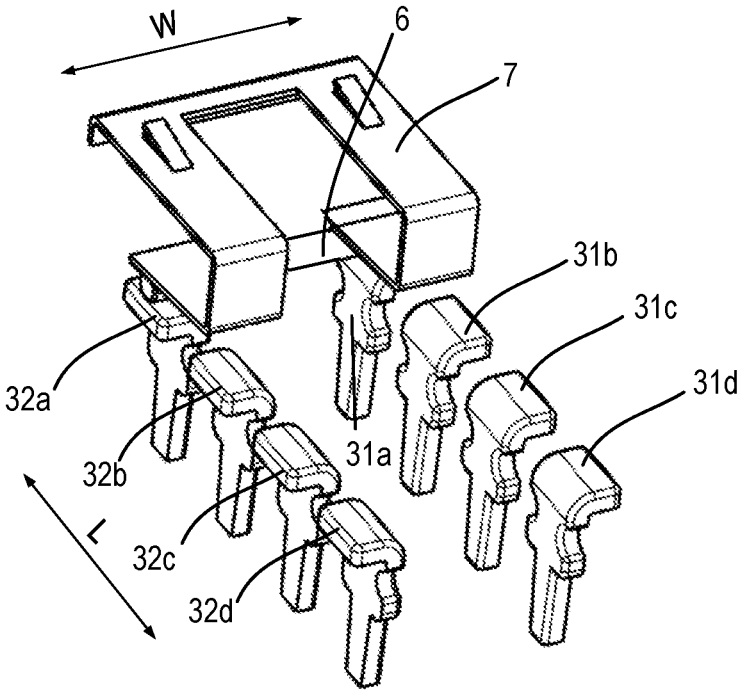
FIG. 5 is a perspective view illustrating the connection terminal, the elastic piece and the conductor rod in an assembled state inside the speed-control switch according to an embodiment of the present disclosure.

As shown in FIGS. 3 and 4, the push rod 2 is at least partially contained in the housing 1, and the first end 21 (for example, an upper end shown in FIG. 3) of the push rod 2 protrudes out of the housing 1 from the central opening 110. The second end 22 (for example, the lower end shown in FIG. 3) of the push rod 2 is provided with a conductor rod 6. The conductor rod 6 is fixedly attached to the second end 22 of the push rod 2 so as to be able to move along with the push rod 2. The conductor rod 6 extends in a width direction W of the housing 1, so that the conductor rod 6 is brought into electrical contact with a pair of connection terminals 31*a*, 32*a*, 31*b*, 32*b*, 31*c*, 32*c* or 31*d*, 32*d* (as shown in FIG. 5) at one speed. More details will be described below.

As shown in FIGS. 4 and 5, the speed-control switch 100 further comprises a plurality of connection terminals 3, which are arranged within the housing 1 in pairs and configured to define a plurality of speed indications of the speed-control switch. For example, the speed indications are ON/OFF, 1, 2 and 3. The plurality of connection terminals 3 include two rows of connection terminals 31*a*, 31*b*, 31*c*, 31*d*; 32*a*, 32*b*, 32*c*, 32*d* spaced apart from each other in the width direction W. The second end 22 of the push rod 2 moves between the two rows of connection terminals. Each pair of connection terminals 31*a*, 32*a*; 31*b*, 32*b*; 31*c*, 32*c*; or 31*d*, 32*d* is arranged symmetrically with respect to the second end 22 of the push rod 2, so that the conductor rod 6 can be in electrical contact with a pair of connection terminals at the same time.

The push button panel 4 is installed on a first surface 114 (for example, an upper surface shown in FIG. 3) of the top plate 11, and is movable relative to the top plate 11. The push button panel 4 includes a recess 41. The recess 41 is recessed from a second surface 42 (for example, a lower surface shown in FIG. 3) of the push button panel 4 and protrudes beyond a plane where the push button panel 4 is located, and the second surface 42 is facing the top plate 11 in the assembled state of the push button panel 4. The first end 21 of the push rod 2 is held in the recess 41, so that the push rod 2 can be driven to slide in the central opening 111 when the push button panel 4 is pushed to move relative to the top plate 11.

As shown in FIGS. 3, 4 and 5, the speed-control switch 100 further includes an elastic piece 7. The elastic piece 7 is attached to the push rod 2 and is in contact with the conductor rod 6, such that the conductor rod 6 is biased toward the connection terminals 3. In the speed-control switch 100 according to the embodiment of the present disclosure, the rubber wheel 8 in the conventional design is not included, so only the elastic piece 7 applies a biasing force to the guide rod 6.

The speed-control switch 100 also includes a speed selection component 5. The speed selection component 5 is configured to allow a selection for a plurality of speed indications of the speed-control switch 100, as the push rod 2 slides in the central opening 110. At least a part of the speed selection assembly 5 is arranged on the top plate 11, so that the position of the speed selection assembly 5 is far away from a plurality of connection terminals 3, that is, away from the second end 22 of the push rod 2 and close to the first end 21 of the push rod 2.

In the speed-control switch according to the embodiment of the present disclosure, the speed selection assembly 5 is arranged far from the connection terminal 3 and partially arranged on the top plate 11. The user can switch the speed with small force only, thereby improving the user experience. The following text will analyze the torque to explain the advantages.

As shown in FIG. 2B, if a point of action of thrust F1 moves from a position P1 to a position P2, then a force arm of F1 will be shortened from L to L', F1*L'<F1*L, then the quantity on the right side of the equation (2) becomes smaller. Under the assumption that L1, L2 and L3 remain unchanged, M1, M2, N1, and N2 will become smaller. Therefore, when the force arm of F1 is reduced, that is, when the distance between the point of resistance and the point of action of thrust is reduced, the resistance applied to the push rod is correspondingly reduced, then the required thrust is also reduced accordingly.

In the speed-control switch 100 according to the embodiment of the present disclosure, when the user switches the speed, the thrust acts on the recess 41 of the push button panel 4 (the push button is formed by the groove), and the resistance mainly comes from the speed selection assembly 5 and the guide groove 32. Therefore, compared with the conventional design of FIG. 2B, point of action of the resistance moves toward the point of action of the thrust, that is to say, the distance between the point of action of the resistance and the point of action of the thrust is reduced, so the required thrust is also reduced.

The structures of the speed selection assembly 5 according to various exemplary embodiments of the present disclosure will be described below with reference to FIGS. 6 to 17.

In an embodiment of the present disclosure, as shown in FIGS. 6 to 17, the speed selection assembly 5 includes: one or more protrusions 51 provided on the push button panel 4, and one or more grooves 52 provided on the top plate 11. The one or more protrusions 51 can be engaged with the one or more grooves 52 for a certain number of times, and the number of times corresponds to the number of a plurality of speed indications such that one of the multiple speed indications is selected for each engagement.

Figure 6:
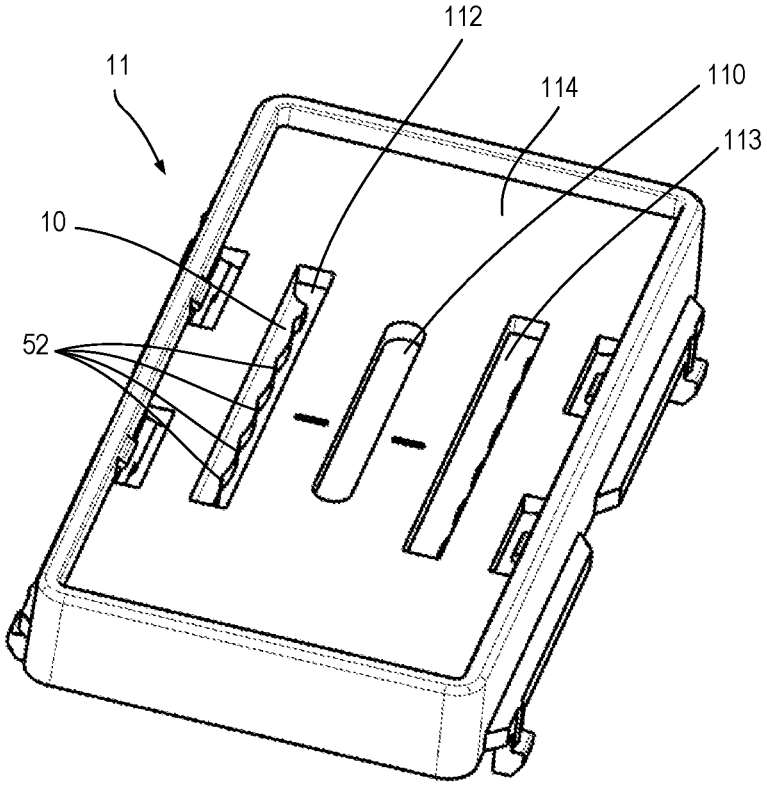
FIG. 6 is a top perspective view illustrating a top plate according to an embodiment of the present disclosure.
Figure 7:
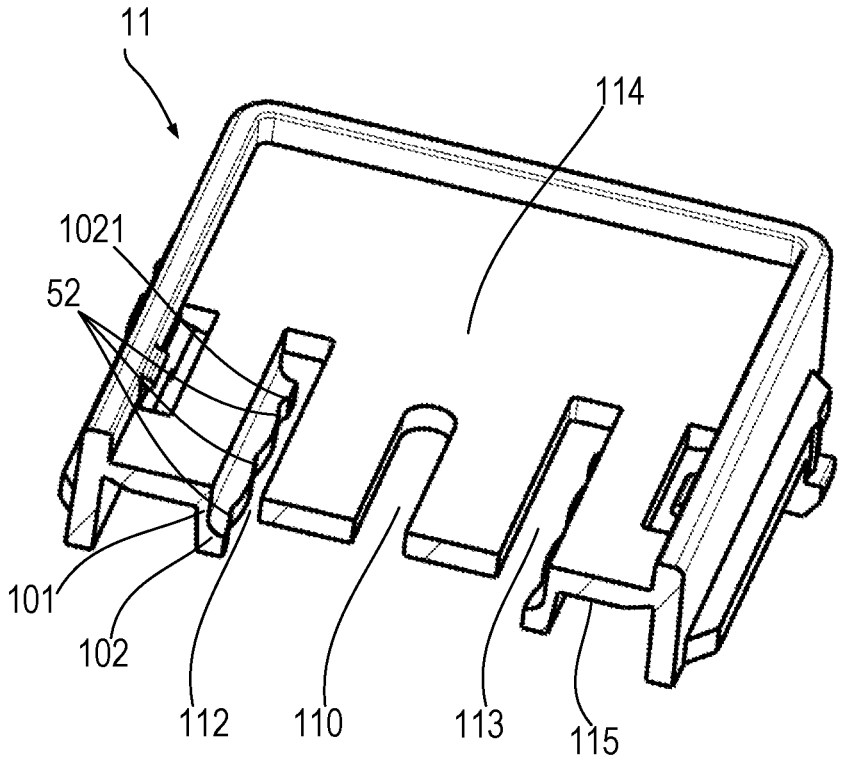
FIG. 7 is a cross-sectional perspective view illustrating a part of the top plate shown in FIG. 6.
Figure 8:
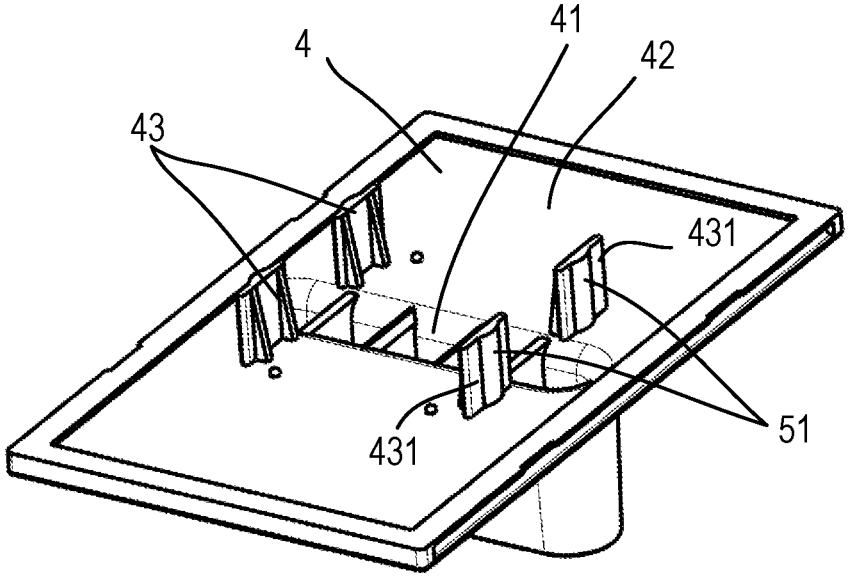
FIG. 8 is a bottom perspective view illustrating a push button panel according to an embodiment of the present disclosure.
Figure 9:
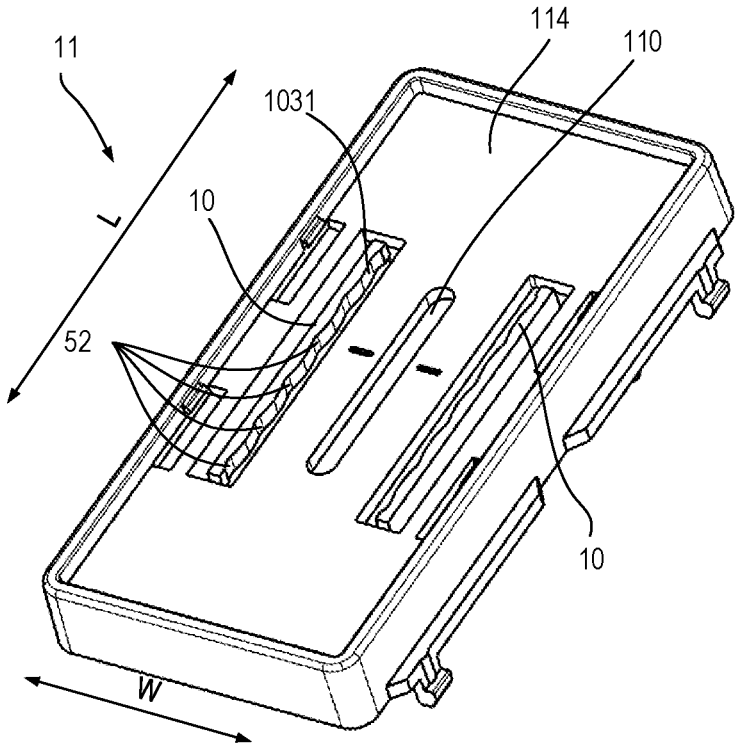
FIG. 9 is a top perspective view illustrating a top plate according to another embodiment of the present disclosure.
Figure 12:
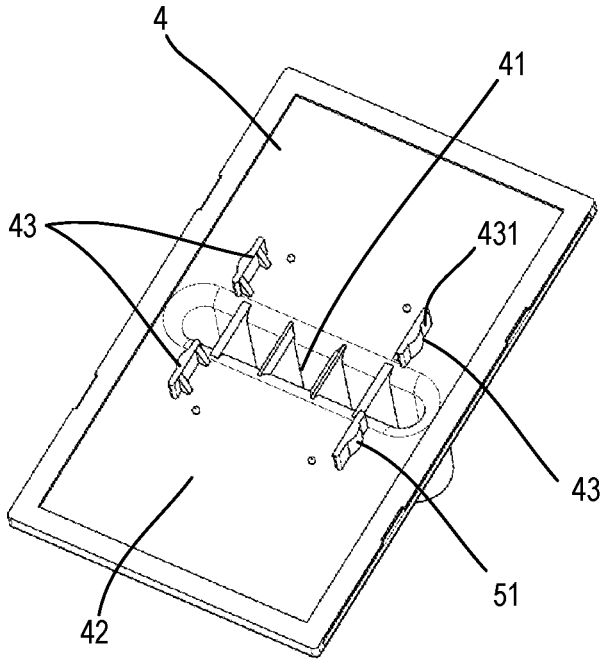
FIG. 12 is a bottom perspective view illustrating a push button panel according to another embodiment of the present disclosure.
Figure 13:
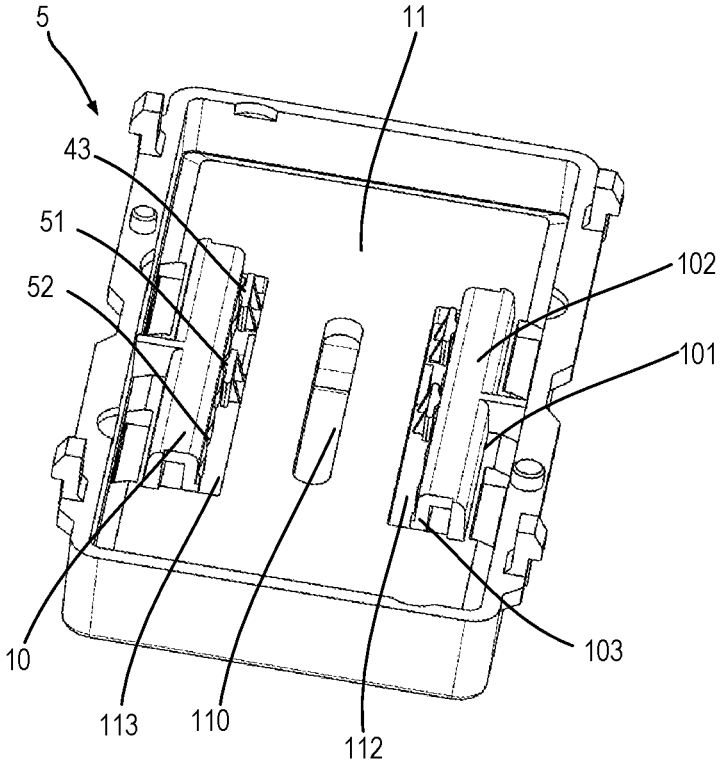
FIG. 13 is a perspective view illustrating a top plate and a push button panel in an assembled state according to another embodiment of the present disclosure.
Figure 14:
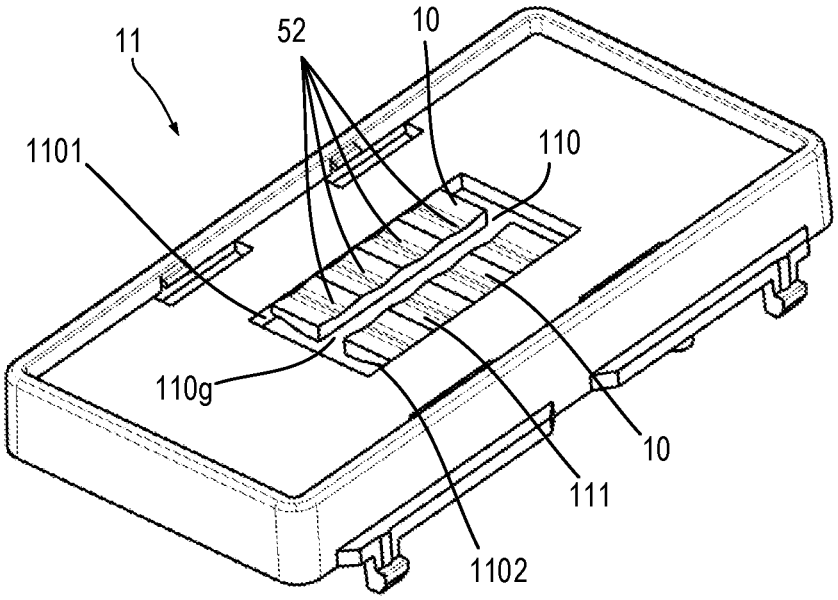
FIG. 14 is a top perspective view illustrating a top plate according to still another embodiment of the present disclosure.

Although the protrusions 51 are all provided on the push button panel 4 and the grooves 52 are all provided on the top plate 11 in the exemplary embodiment shown in FIGS. 6 to 17, the technical solution of the present disclosure is not limited thereto. The groove 52 can also be provided at an appropriate position on the push button panel 4, and the protrusion 51 can also be provided at an appropriate position on the top plate 11, as long as the grooves 52 and the protrusions 51 can be engaged for multiple times and the number of engagements corresponds to the number of multiple speed indications. For example, the cantilever 10 (described in detail below) as shown in FIGS. 6, 9 and 14 can also be provided on the push button panel 4. The support arm 43 shown in FIGS. 8, 12, 15 and 17 (which will be described in detail below) can also extend from the top plate 1. The implementations of all these variants fall within the scope of the present disclosure.

In the embodiment of the present disclosure, the selection for the speed is realized by an engagement of the groove 52 and the protrusion 51. The rubber wheel 8 and the spacer 9 in the conventional design can be omitted, and the grooves 52 and the protrusions 51 can be arranged on the existing push button panel and the top plate 11 without adding additional parts, so the required components are reduced, and cost, assembly time and assembly difficulty of such speed-control switch are reduced. In addition, since the rubber wheel 8 in the conventional design is omitted and only the elastic piece 7 is used to apply biasing force to the conductor rod 6, the biasing force is stable. Therefore, the conductor rod 6 and the connection terminal 3 can directly contact and there is no insulating air therebetween, and thus the contact resistance is small. Therefore, the speed-control switch 100 according to the embodiment of the present disclosure can be applied to electrical appliances that use relatively large current and have high power.

In an embodiment of the present disclosure, as shown in FIGS. 6 to 17, the one or more grooves 52 are formed in the form of troughs of a wavy surface, and the one or more protrusions 51 are formed in the form of crests of the wavy surface. The wavy shape shown in the figures is only exemplary. The groove 52 and the protrusion 51 may include any other suitable shapes as long as the shape is suitable for the groove 52 to slide on the plurality of protrusions 51, or the protrusion 51 can slide on the plurality of grooves 52. The implementations of all these modifications fall within the scope of the present disclosure.

As shown in FIGS. 7 and 9, the top plate 11 is provided with a first opening 112 and a second opening 113, which are located on both sides of the central opening 110. The cantilever 10 can be provided in one of the openings, or in the two openings, and the technical solution of the present disclosure is not limited thereto. The technical solution of the present disclosure does not limit the number of cantilevers 10 provided in each opening either. The cantilever 10 is spaced apart from the first opening 112 or the second opening 113 in the length direction L of the top plate 11. As shown in FIG. 14, the cantilever 10 may be disposed in the central opening 110 of the top plate 11, and the number thereof is not limited to two as shown in FIG. 14. In the embodiments shown in FIGS. 7, 9 and 14, the cantilevers 10 are all spaced apart from the top plate 11 at both ends thereof in the length direction, so that the cantilever 10 can perform better elastic deformation.

Hereinafter, the speed selection assembly 5 according to an embodiment of the present disclosure will be described with reference to FIGS. 6-8, wherein FIG. 6 shows a top perspective view of the top plate, FIG. 7 shows a cross-sectional perspective view of a part of the top plate shown in FIG. 6 and FIG. 8 shows a bottom perspective view of the push button panel 4.

As shown in FIG. 7, the cantilever 10 includes a first arm plate 101 and a second arm plate 102. The first arm plate 101 extends perpendicularly to the top plate 11 from the second surface 115 (the lower surface as shown in FIG. 7). The second arm plate 102 extends toward the central opening 110 from an end (the lower end as shown in FIG. 7) of the first arm plate 101 away from the top plate 11. The groove 52 is provided on a surface 1021 of the second arm plate 102 facing the central opening 110.

As shown in FIG. 8, the second surface 42 of the push button panel 4 is provided with a support arm 43 perpendicular to the second surface 42 and extending downward from the second surface 42. As shown in FIG. 8, the number of the support arms 43 is 4, and the support arms 43 are arranged symmetrically. However, the number is exemplary and it can be any integer, but is preferably an even number. The implementations of all these variants fall within the scope of the present disclosure.

As shown in FIG. 8, the protrusion 51 is provided on an outward-facing side surface 431 of the support arm 43. When the top plate 11 and the push button panel 4 are assembled together, the support arm 43 is much closer to the central opening 110, compared with the cantilever 10. The protrusion 51 on the surface 431 of the support arm 43 engages with a groove 52 on the cantilever 10. Each protrusion 51 can slide on a plurality of grooves 52 on the cantilever 10, and each protrusion 51 can be engaged with a plurality of grooves 52. The number of the plurality of grooves 52 engaged with each protrusion 51 is equal to the number of the plurality of speed indications, or an integer multiple of the number of the plurality of speed indications. The present disclosure does not limit the number of the grooves 52, as long as each protrusion 51 can be engaged with a sufficient number of grooves 52.

As shown in FIG. 7, the cantilever 10 and the top plate 11 are integrally formed of plastic. The first arm plate 101 extends by a certain size in the thickness direction of the top plate 11, so that the lower end of the first arm plate 101 is away from the top plate 11. In this way, the cantilever 10 can have good elasticity and can be elastically deformed. When the groove 52 and the protrusion 51 are engaged, the cantilever 10 can bias the groove 52 toward the protrusion 51, and when relative movement occurs between the groove 52 and the protrusion 51, the cantilever 10, especially the first arm plate 101, can be elastically deformed. As a result, the friction force generated during the above-mentioned relative movement is relatively small, so that the speed can be switched with a relatively small thrust.

Hereinafter, the speed selection assembly 5 according to another embodiment of the present disclosure will be described with reference to FIGS. 9 to 13. FIG. 9 shows a top perspective view of the top plate, and FIG. 10 shows a cross-sectional perspective view of a part of the top plate shown in FIG. 9, and FIG. 11 shows a top view of the top plate shown in FIG. 10, and FIG. 12 shows a bottom perspective view of the push button panel, and FIG. 13 shows a perspective view of the top panel and the push button panel in an assembled state.

Figure 10:
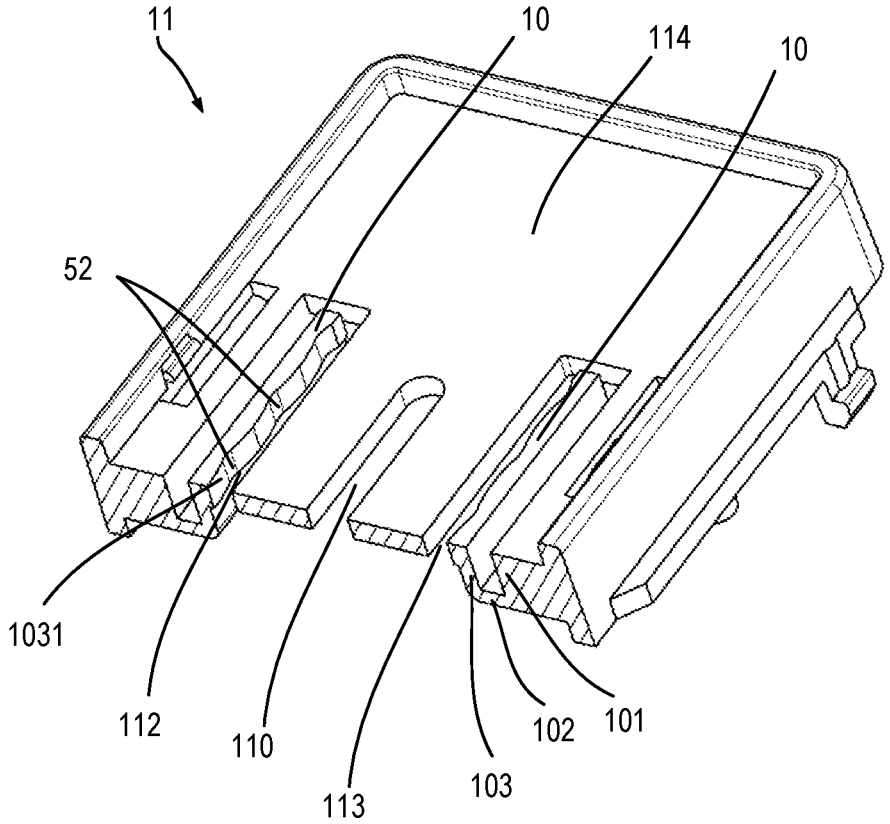
FIG. 10 is a cross-sectional perspective view illustrating a part of the top plate shown in FIG. 9.
Figure 11:
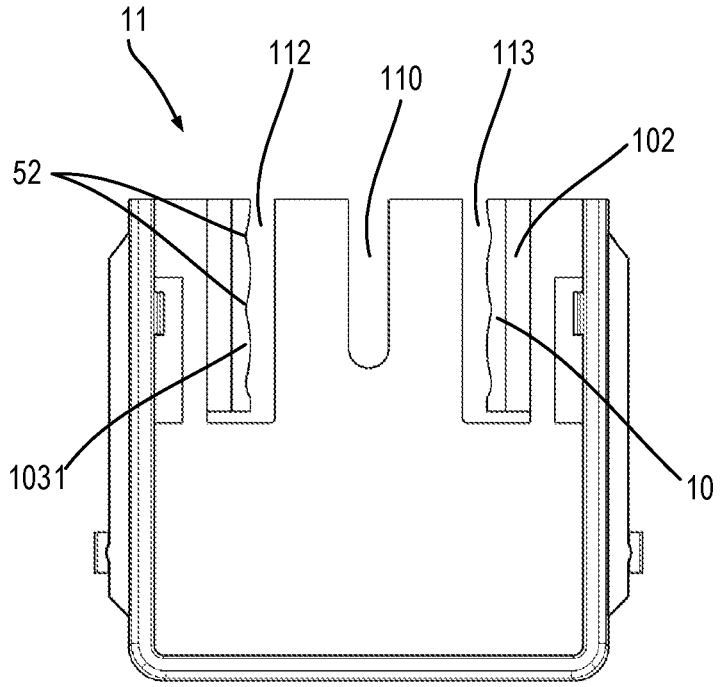
FIG. 11 is a plan view illustrating the top plate shown in FIG. 10.

As shown in FIGS. 9 to 11, the cantilever 10 includes a first arm plate 101, a second arm plate 102, and a third arm plate 103. The first arm plate 101 extends perpendicularly to the top plate 11 from the first surface 114 of the top plate 11. In this embodiment, the first arm plate 101 may be integrally formed with a side wall of the top plate 11, and the thickness of the side wall is relatively large. The second arm plate 102 extends towards the central opening 110 from an end (for example, the lower end as shown in FIGS. 9 and 10) of the first arm plate 101 away from the top plate 11. The third arm plate 103 extends perpendicularly to the second arm plate 102 from an end (for example, the inner end as shown in FIGS. 9 and 10) of the second arm plate 102 away from the first arm plate 101, so that the third arm plate 103 and the first arm plate 101 (or the side wall of the top plate 11) are opposite to each other. The grooves 52 are provided on a surface 1031 of the third arm plate 103 facing the central opening 110. The push button panel 4 shown in FIG. 12 is similar to the push button panel 4 shown in FIG. 8, except that the setting position of the support arm 43 may be changed. In the embodiment shown in FIG. 12, the setting position of the support arm 43 needs to correspond to the position of the third arm plate 103.

Those skilled in the art should understand that the number of the protrusions 51 and the grooves 52 as shown in FIGS. 9 to 13 is only shown for the purpose of illustration, and can be changed as needed.

In the speed selection assembly 5 according to this embodiment, the cantilever 10 and the top plate 11 are integrally molded from plastic. The third arm plate 103 is spaced apart from the first arm plate 101, and is separated from the top plate 11 at both ends thereof in the length direction. Therefore, the third arm plate 13 can possess better elasticity, providing a smoother speed switching operation.

Figure 15:
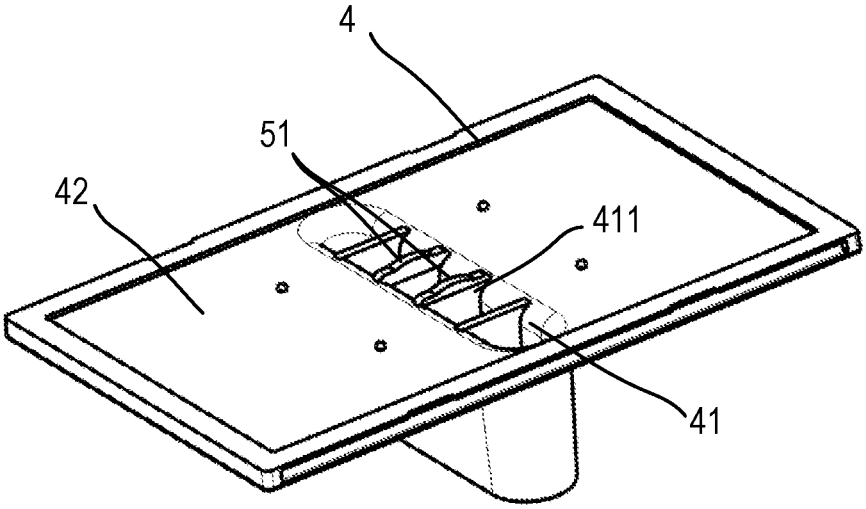
FIG. 15 is a bottom perspective view illustrating a push button panel according to still another embodiment of the present disclosure.

Hereinafter, the speed selection assembly 5 according to another embodiment of the present disclosure will be described in conjunction with FIGS. 14 to 15, wherein FIG. 14 shows a top perspective view of the top plate, and FIG. 15 shows a bottom perspective view of the push button panel 4.

As shown in FIG. 14, the cantilever 10 extends parallel to the top plate 11 from a side wall 1101 or 1102 of the central opening 110 of the top plate 11. The groove 52 is provided on a surface 111 (the upper surface shown in FIG. 14) of the cantilever 10 facing the second surface 42 of the push button panel 4. The protrusion 51 extends from the second surface 42 (for example, the lower surface as shown in FIG. 15) of the push button panel 4. Specifically, as shown in FIG. 15, in the recess 41, there are four partitions 411 to form 5 small cavities. The two partitions 411 at the middle position form a middle small cavity, in which the push rod 2 is installed. The protrusion 51 extends from a bottom of each of the two partitions 411. Although the protrusion 51 extends from the partition 411 as shown in FIG. 15, those skilled in the art can understand that the protrusion 51 can be provided in other positions as long as the protrusion 51 can be engaged with the groove 52 on the cantilever 10, for example, the protrusion 51 can also extend from the second surface 42 of the push button panel 4.

In this embodiment, the cantilever 10 and the top plate 11 are also integrally formed of plastic, which forms the cantilever 10 in a simpler manner. In this way, there is no need to provide two openings 112 and 113. Since the cantilever 10 extends by a certain distance from the side wall 1101 or 1102, it possesses good elasticity. As shown in FIG. 14, it can be elastically deformed in the up and down direction, thereby providing a smoother speed switching operation.

The structure of the cantilever 10 as shown in FIGS. 6, 9 and 14 is only an exemplary embodiment of the cantilever 10. According to the teachings given in the present disclosure, those skilled in the art could conceive of using any other suitable way to form the cantilever 10. The implementations of all these variants fall within the scope of the present disclosure.

Figure 16:
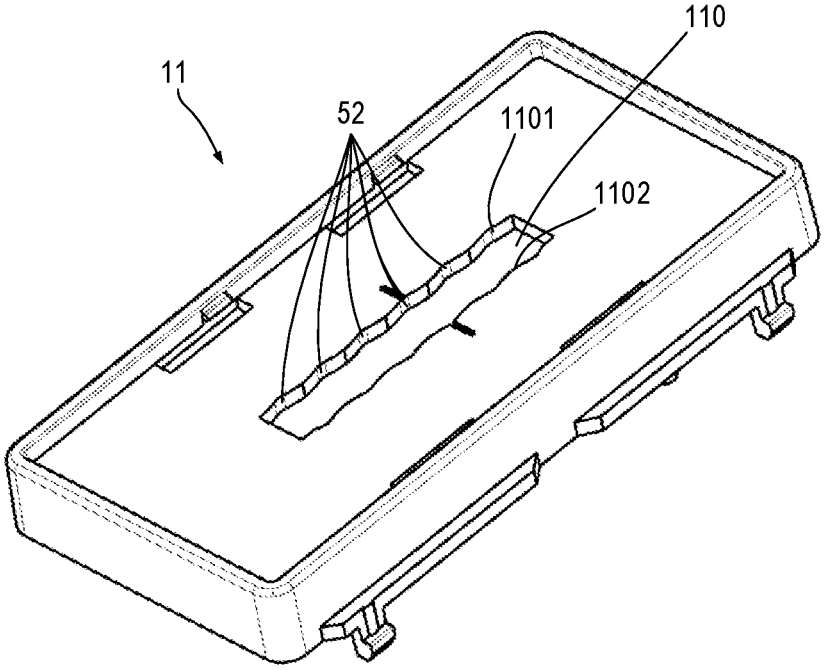
FIG. 16 is a top perspective view illustrating a top plate according to still another embodiment of the present disclosure.
Figure 17:
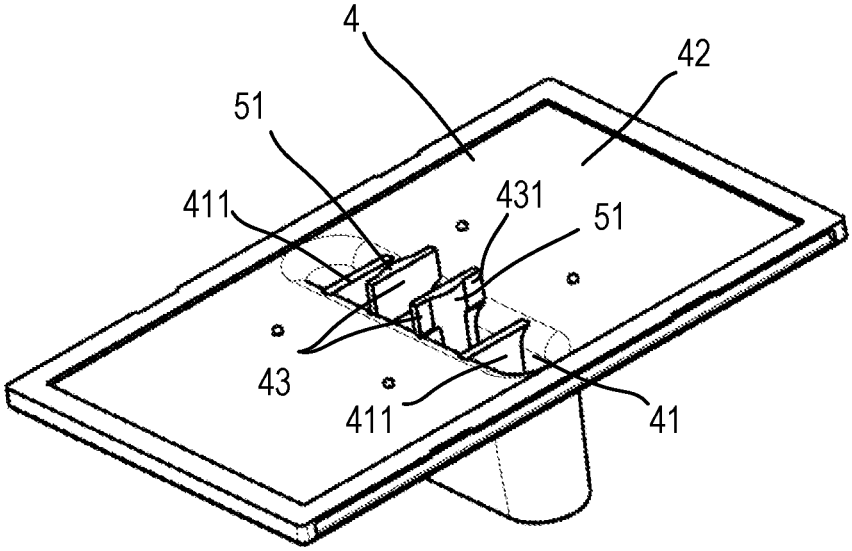
FIG. 17 is a bottom perspective view illustrating a push button panel according to still another embodiment of the present disclosure.

Hereinafter, the speed selection assembly 5 according to a further embodiment of the present disclosure will be described with reference to FIGS. 16 to 17, wherein FIG. 16 shows a top perspective view of the top plate 11, and FIG. 17 shows a bottom view of the push button panel 4.

As shown in FIG. 16, the grooves 52 are directly arranged on the side walls 1101 and 1102 of the central opening 110 of the top plate 11. As shown in FIG. 17, in the recess 41, there are four partitions 411 to form 5 small cavities. Two partitions 411 at the middle position form a middle small cavity, in which the push rod 2 is installed. The support arms 43 each extend from the bottom of each of the two partitions 411. The protrusion 51 is provided on the outward-facing side surface 431 of the support arm 43. Although the support arm 43 shown in FIG. 17 extends from the partition 411, those skilled in the art could understand that the support arm 43 can extend from other positions, as long as the protrusion 51 provided on the outward-facing side surface 431 of the support arm 43 can be engaged with the groove 52. For example, the support arm 43 could extend from the second surface 42 of the push button panel 4. In this embodiment, the support arm 43 can extend by a relatively long distance in the thickness direction of the push button panel 4, showing better elasticity.

In this embodiment, the grooves 52 are directly provided in the central opening 111 of the top plate 11, and thus formed in a very simple manner. In this way, there is no need to provide the cantilever 10 and the opening for containing the cantilever 10. Since the top plate 11 is formed of a plastic material, and the support arm 43 extends by a long distance, the protrusion 51 and the groove 52 can be elastically engaged, thereby providing a smooth speed switch operation.

The embodiments of the present disclosure have been described above, and the above description is exemplary, not exhaustive, and is not limited to the disclosed embodiments. Without departing from the scope and spirit of the illustrated embodiments, many modifications and changes are obvious to those skilled in the art. The selection of terms used herein is intended to best explain the principles, practical applications of the various embodiments, or improvements to the technology in the market, or to enable others of ordinary skill in the art to understand the various embodiments disclosed herein.

The above are only optional embodiments of the present disclosure and are not used to limit the present disclosure. For those skilled in the art, the present disclosure may have various modifications and changes. Any modification, equivalent replacement, improvement, etc., made within the spirit and principle of the present disclosure shall be included in the protection scope of the present disclosure.

We claim:

1. A speed-control switch, comprising:

a housing comprising a top plate provided with a central opening extending in a length direction;

a push rod at least partially received in the housing, a first end of the push rod protruding out of the housing from the central opening and capable of sliding in the central opening;

a plurality of connection terminals provided in pairs in the housing and configured to selectively engage with a second end of the push rod opposite to the first end to define a plurality of speed indications of the speed-control switch;

a speed selection assembly, a part of the speed selection assembly being provided on the top plate, and the speed selection assembly being configured to allow a selection for the plurality of speed indications of the speed-control switch, as the push rod slides in the central opening; and a push button panel provided on a first surface of the top plate and capable of translating relative to the top plate, wherein the speed selection assembly comprises:

one or more protrusions provided on one of the top plate and the push button panel; and one or more grooves provided on the other of the top plate and the push button panel, wherein the one or more protrusions can be engaged with the one or more grooves for a certain number of times corresponding to a number of the plurality of speed indications.

2. The speed-control switch according to claim 1, wherein the one or more grooves are formed in the form of troughs of a wavy surface, and the one or more protrusions are formed in the form of crests of the wavy surface.

3. The speed-control switch according to claim 1, wherein each of the one or more grooves can be engaged with a certain number of the protrusions corresponding to the number of the plurality of speed indications.

4. The speed-control switch according to claim 1, wherein each of the one or more protrusions can be engaged with a certain number of the grooves corresponding to the number of the plurality of speed indications.

5. The speed-control switch according to claim 1, wherein the one or more grooves are provided on a side wall of the central opening of the top plate; and the one or more protrusions are provided on an outward-facing side surface of a support arm, the support arm extending from the push button panel in a direction perpendicular to the push button panel.

6. The speed-control switch according to claim 1, wherein the housing further comprises a lower housing to which the top plate is attached.

7. The speed-control switch according to claim 1, wherein the housing is provided with a guide groove, and the push rod is provided with a guided portion at a middle position of the push rod, wherein the guided portion slides in the guide groove.

8. The speed-control switch according to claim 1, wherein the push button panel is configured to be engaged with the first end of the push rod protruding from the central opening, so that the push rod can slide in the central opening with the translating of the push button panel relative to the top plate.

9. The speed-control switch according to claim 8, wherein the push button panel comprises a recess recessed from a second surface of the push button panel facing the top plate in an assembled state and protruding beyond a plane where the push button panel is located, and the first end of the push rod is held within the recess.

10. The speed-control switch according to claim 1, wherein the second end of the push rod is provided with a conductor rod fixedly attached to the second end of the push rod and extending in a width direction, and at one of the plurality of speed indications, the conductor rod causes a pair of connection terminals of the plurality of connection terminals to be electrically conducted.

11. The speed-control switch according to claim 10, wherein the plurality of connection terminals comprise two rows of connection terminals spaced apart from each other in the width direction, and the second end of the push rod moves between the two rows of connection terminals; and each pair of connection terminals is symmetrically arranged with respect to the second end of the push rod.

12. The speed-control switch according to claim 10, further comprising an elastic piece attached to the push rod and in contact with the conductor rod to bias the conductor rod toward the plurality of connection terminals.

13. The speed-control switch according to claim 1, wherein the one or more grooves are provided on a cantilever extending from the top plate.

14. The speed-control switch according to claim 13, wherein the top plate is provided with a first opening and a second opening located on both sides of the central opening, respectively, the cantilever is provided in at least one of the first opening and the second opening, and the cantilever is spaced apart from the first opening and the second opening in the length direction.

15. The speed-control switch according to claim 13, wherein the cantilever comprises:

a first arm plate extending perpendicularly to the top plate from a second surface of the top plate opposite to the first surface; and a second arm plate extending towards the central opening from an end of the first arm plate away from the top plate, wherein the one or more grooves are provided on a surface of the second arm plate facing the central opening, and wherein the one or more protrusions are provided on an outward-facing side surface of a support arm, the support arm extending from a second surface of the push button panel facing the top plate in an assembled state.

16. The speed-control switch according to claim 13, wherein the cantilever comprises:

a first arm plate extending perpendicularly to the top plate from the first surface of the top plate;

a second arm plate extending towards the central opening from an end of the first arm plate away from the top plate, a third arm plate extending perpendicularly to the second arm plate from an end of the second arm plate away from the first arm plate, wherein the one or more grooves are provided on a surface of the third arm plate facing the central opening, and wherein the one or more protrusions are provided on an outward-facing side surface of a support arm, the support arm extending from a second surface of the push button panel facing the top plate in an assembled state.

17. The speed-control switch according to claim 13, wherein the cantilever extends parallel to the top plate from a side wall of the central opening of the top plate;

the one or more grooves are provided on a surface of the cantilever facing a second surface of the push button panel, the second surface facing the top plate in an assembled state; and the one or more protrusions extend from the push button panel toward the top plate.

18. The speed-control switch according to claim 17, wherein the cantilever is spaced apart from the central opening in the length direction, and the push rod slides in a gap between opposite cantilevers extending from opposite side walls of the central opening.

* * * * *